US011878855B2

(12) United States Patent
Colomb

(10) Patent No.: US 11,878,855 B2
(45) Date of Patent: Jan. 23, 2024

(54) METERING VALVE HAVING AN IMPROVED METERING CHAMBER

(71) Applicant: APTAR FRANCE SAS, Le Neubourg (FR)

(72) Inventor: Arnaud Colomb, Verneuil sur Seine (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 17/797,742

(22) PCT Filed: Feb. 5, 2021

(86) PCT No.: PCT/FR2021/050217
§ 371 (c)(1),
(2) Date: Aug. 5, 2022

(87) PCT Pub. No.: WO2021/156580
PCT Pub. Date: Aug. 12, 2021

(65) Prior Publication Data

US 2023/0107497 A1 Apr. 6, 2023

(30) Foreign Application Priority Data

Feb. 7, 2020 (FR) ..... 2001216

(51) Int. Cl.
*B65D 83/54* (2006.01)
*B65D 83/14* (2006.01)

(52) U.S. Cl.
CPC ..... *B65D 83/54* (2013.01); *B65D 83/752* (2013.01)

(58) Field of Classification Search
CPC ..... B65D 83/54; B65D 83/752
See application file for complete search history.

(56) References Cited

U.S. PATENT DOCUMENTS 4,863,073 A * 9/1989 Burt ..... G01F 11/36 222/402.2
5,037,012 A * 8/1991 Langford ..... B65D 83/54 222/402.2

(Continued)

FOREIGN PATENT DOCUMENTS

FR 2 860 502 A1 4/2005
FR 3 042 785 A1 4/2017

(Continued)

OTHER PUBLICATIONS

International Search Report for PCT/FR2021/050217 dated Jun. 2, 2021.

(Continued)

*Primary Examiner* — Bob Zadeh
(74) *Attorney, Agent, or Firm* — Sughrue Mion, PLLC

(57) ABSTRACT

Metering valve for dispensing a fluid product, having a valve body containing a metering chamber defined by a chamber insert and two annular seals, a valve seal and a chamber seal. The chamber insert has a cylindrical wall, an upper edge cooperating with the valve seal and a lower edge that cooperates with the chamber seal. A valve slides axially in the valve body between a rest position and a dispensing position, so as to selectively dispense the contents of the metering chamber, the valve being urged towards its rest position by a spring that cooperates with the valve body and with the valve. The upper edge of the chamber insert has an annular cutout formed on the radially inner side of the upper edge, so that the width of the upper edge in contact with the valve seal is always the same, whatever the width of the cylindrical wall.

12 Claims, 2 Drawing Sheets

(56) References Cited

U.S. PATENT DOCUMENTS

Figure 1:
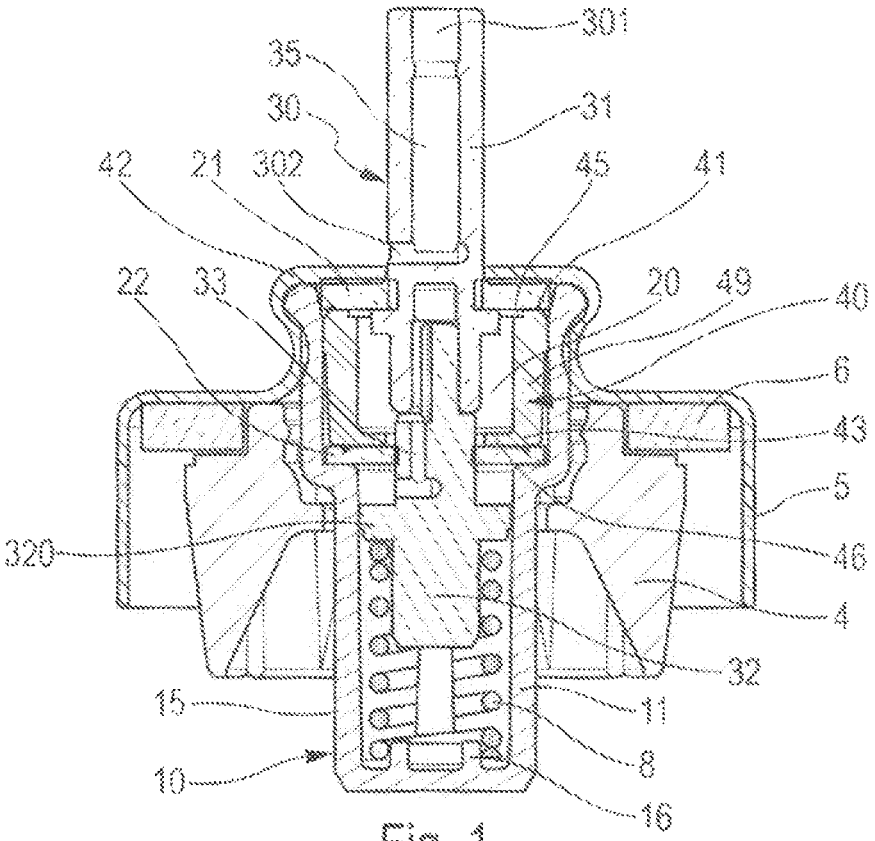

| | | | | |
|---|---|---|---|---|
| 5,169,038 | A | 12/1992 | Di Giovanni | |
| 2003/0180228 | A1* | 9/2003 | Cripps | A61P 11/00 128/200.23 |
| 2003/0192917 | A1* | 10/2003 | Eames | B65D 83/425 222/402.1 |
| 2008/0087688 | A1 | 4/2008 | Twyman | |
| 2008/0190418 | A1* | 8/2008 | Miller | A61M 15/009 128/200.23 |
| 2015/0232260 | A1* | 8/2015 | Dann | A61K 33/30 222/402.1 |
| 2023/0107497 | A1* | 4/2023 | Colomb | B65D 83/752 222/71 |

FOREIGN PATENT DOCUMENTS

| | | | | |
|---|---|---|---|---|
| GB | 2 401 099 | A | 11/2004 | |
| WO | WO-2009015456 | A1 * | 2/2009 | A61K 38/28 |
| WO | 2014/096657 | A1 | 6/2014 | |

OTHER PUBLICATIONS

International Preliminary Report on Patentability with Translation of the Written Opinion of the International Searching Authority dated Jul. 28, 2022 in International Application No. PCT/FR2021/050217.

* cited by examiner

METERING VALVE HAVING AN IMPROVED METERING CHAMBER

CROSS REFERENCE TO RELATED APPLICATIONS

This application is a National Stage of International Application No. PCT/FR2021/050217 filed Feb. 5, 2021, claiming priority based on French Patent Application No. FR2001216 filed Feb. 7, 2020.

The present invention relates to a metering valve for a device for dispensing a fluid product.

So-called metering valves, in which upon each actuation of the valve, a specific dose of fluid product is dispensed, are well-known in the state of the art, and are generally assembled on a reservoir containing the fluid product and a propellant used to perform the expulsion of the dose.

Two types of metering valves are mainly known. So-called retention valves comprise a valve which, in the rest position, partially closes the metering chamber. More precisely, the outside of the valve cooperates in a sealed manner with the chamber seal of the metering chamber in such a way that the metering chamber, in this rest position, is connected to the reservoir only via the internal channel of the valve. So-called non-priming valves comprise a metering chamber which, at rest, is open on the reservoir and which is filled at the time of actuation, when the user returns the device into the inverted position of use.

According to the product to be dispensed and/or the patient, the dose dispensed upon each actuation can vary, for example from 25 to 75 μl. A solution is to use a more or less wide insert in the metering chamber, according to the desired volume. This solution has the drawback of modifying the behaviour of the valve seal, which rests on said insert, in particular from a seal deformation and swelling standpoint.

Moreover, around fifteen years ago, for ecological reasons, the propellants previously used, which were generally CFC-based, have been replaced by other propellants, namely the propellants HFA-134a and/or HFA-227. It has proved to be that this modification of the propellant would cause different constraints on the seals, whatever the sealing performance level of said seal, in particular of its swelling, or removable ones, when said seal was in contact with these new propellants. Due to this, the seal materials usually used in aerosol valves in conjunction with CFC gases could not be simply applied to the new propellant HFA-134a and/or HFA-227. The transition thus has taken numerous years, with in particular, the development of new seal materials.

Today, it has proved to be that the gases HFA-134a and/or HFA-227 are also harmful for the environment, and it is necessary to replace them by gases which are less harmful for the environment, such as HFA-152a or HFO1234ze.

Yet, again this replacement modifies the behaviour of the seal materials used today in metering valves, and in particular increases the swelling of the seals. This can represent a problem for a reliable actuation of the valve, potentially generating blockages of the valve and involving a greater actuation force. A solution would be to develop new seal materials specifically adapted to this new propellant, but the past experience of replacing CFC gases has shown that this can take several years. The present invention seeks, on the contrary, to keep the same seal materials, and thus proposes a structural modification of the valve enabling to compensate for the swelling of the seals, while limiting as much as possible, the modifications on production and assembly line of the valve.

Documents WO2014096657, FR3042785 and FR2860502 describe devices of the state of the art.

An object of the present invention is to provide a metering valve that does not have the abovementioned drawbacks.

Thus, an object of the present invention is to provide a metering valve which does not modify the behaviour of the valve seal, whatever the volume of the metering chamber.

Another object of the present invention is to provide a metering valve which guarantees a reliable operation with the less harmful gas, such as HFA-152a or HFO1234ze, without modifying the seal materials.

A particular object of the present invention is to provide a metering valve that is simple and inexpensive to manufacture and to assemble, and that is reliable in operation.

Thus, an object of the present invention is a metering valve for dispensing a fluid product, comprising a valve body containing a metering chamber, said metering chamber being defined by a chamber insert and two annular seals, a valve seal and a chamber seal, said chamber insert comprising a cylindrical wall, an upper edge that cooperates with said valve seal and a lower edge that cooperates with said chamber seal, a valve sliding axially in said valve body between a rest position and a dispensing position, to selectively dispense the contents of said metering chamber, said valve being urged towards its rest position by a spring that cooperates, on the one hand, with said valve body and on the other hand, with said valve, said upper edge of said chamber insert comprising an annular cutout formed on the radially inner side of said upper edge, in such a way that the width of said upper edge in contact with said valve seal is always the same, whatever the width of said cylindrical wall.

Advantageously, said annular cutout is of a rectangular shape in transverse cross-section.

Advantageously, said lower edge of said chamber insert is radially extended inwards by a flange which increases the contact surface with said chamber seal, said contact surface always being the same, whatever the width of said cylindrical wall.

Advantageously, said metering chamber has a variable volume, in particular of between 25 and 75 μl, defined by the radial width of said cylindrical wall.

Advantageously, the metering chamber has a volume of 50 μl.

Advantageously, the metering chamber has a volume of 28 μl.

Advantageously, the axial dimension of said annular cutout is less than 15%, advantageously less than 10%, of the axial dimension of said cylindrical wall.

Advantageously, the axial dimension of said annular cutout is less than the axial dimension of a radial shoulder of said valve which, in the rest position of said valve, bears under said valve seal.

Another object of the present invention is a device for dispensing a fluid product comprising a metering valve such as defined above, said valve being mounted on a reservoir containing the fluid product and a propellant.

Advantageously, said propellant comprises HFA-152a and/or HFO1234ze.

Figure 2:
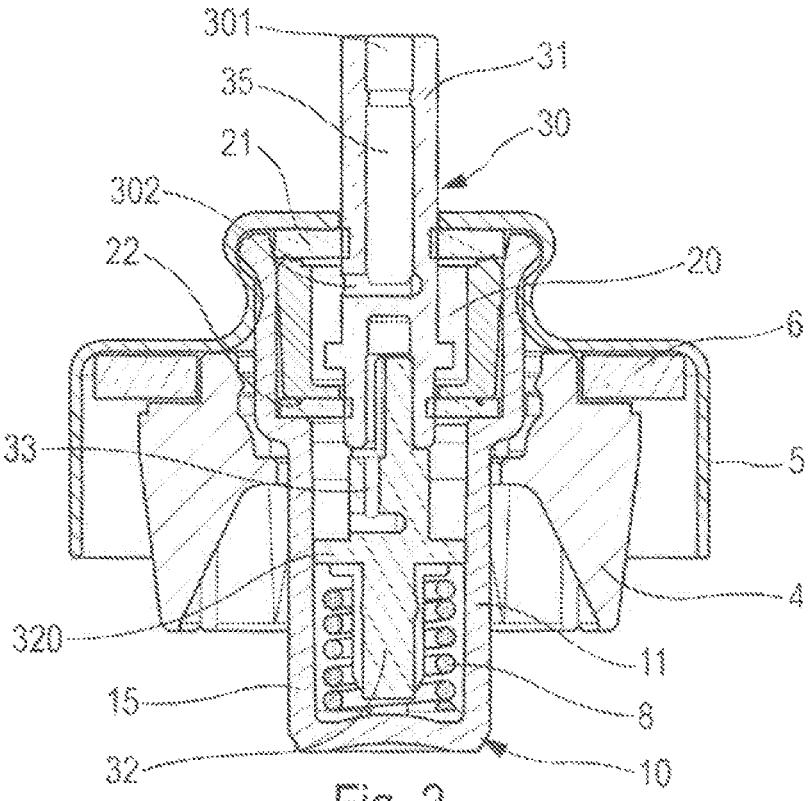
Figure 3:
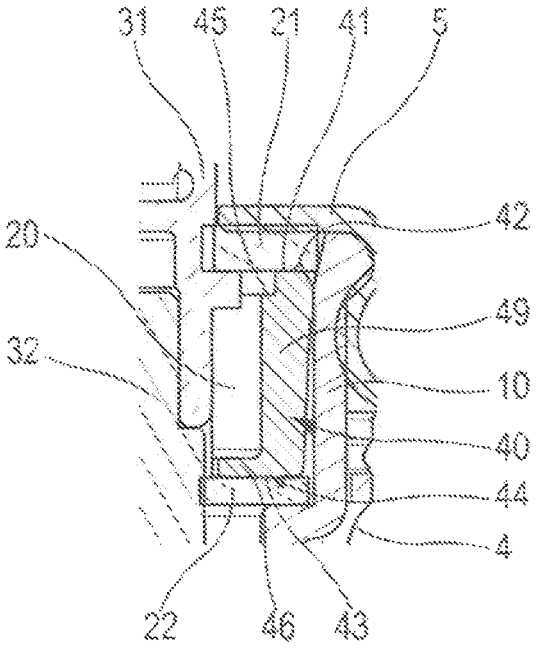
Figure 4:
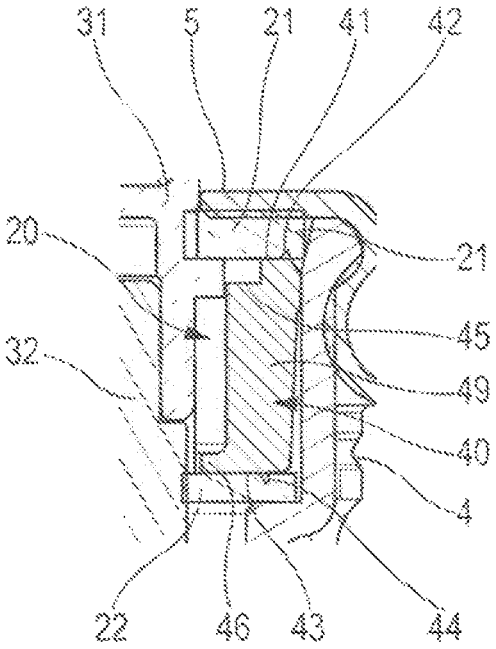

These characteristics and advantages and others of the present invention will appear more clearly from the following detailed description thereof, given by way of non-limiting examples, and with reference to the accompanying drawings, and in which:

FIG. 1 is a transverse, cross-sectional schematic view of a dispensing valve according to a first embodiment, in the rest position of the valve, in the upright storage position of the valve, FIG. 2 is a view similar to that of FIG. 1, according to a second embodiment, in the actuation position of the valve, FIGS. 3 and 4 are vertical, cross-sectional detailed views of the metering chamber of FIGS. 1 and 2, and FIG. 4 see FIG. 3

Figure 5:
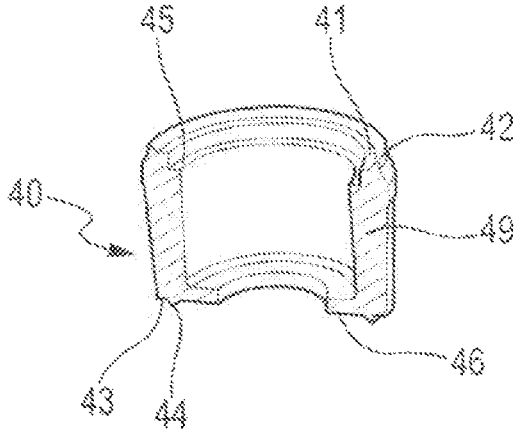
Figure 6:
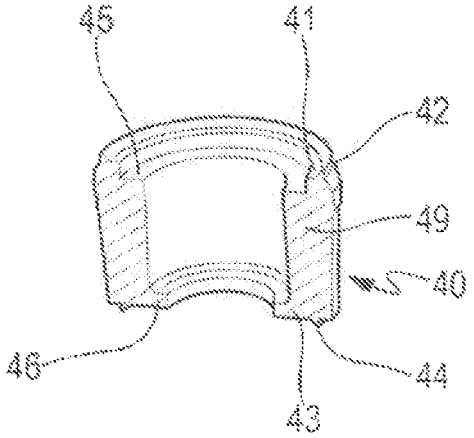

FIGS. 5 and 6 are cut-out, perspective, detailed views of the metering chamber of FIGS. 3 and 4.

FIG. 6 see FIG. 5

In the description below, the terms "top", "bottom", "lower", "upper" and "vertical" refer to the upright position represented in FIG. 1, and the terms "axial" and "radial" refer to the longitudinal central axis of the valve.

FIG. 1 represents the valve in the upright storage position, i.e. the position in which the valve is arranged above the reservoir. FIG. 2 represents the valve in the actuation position. It must be noted that the normal position of use of such a valve is an inverted position, with the valve arranged under the reservoir, but in this FIG. 2, the position of use of the valve has been represented in the upright position, to simplify the comparison with the rest position of FIG. 1.

The metering valve represented in FIG. 1 comprises a valve body 10 extending along a longitudinal central axis and containing a metering chamber 20. This metering chamber 20 is defined between two annular seals, a valve seal 21 and a chamber seal 22, in a well-known manner. This metering chamber 20 is filled before or after each actuation with a dose of fluid product from the reservoir.

Inside said valve body 10, a valve 30 slides between a rest position, which is the position shown in FIG. 1, and a dispensing position as shown in FIG. 2, in which the valve 30 has been pushed into the valve body 10.

This valve is intended to be assembled on a reservoir containing the fluid product and a propellant, preferably by means of a fixing element 5, which can be a crimpable, screw-fastenable, or snap-fastenable capsule, and advantageously with interposition of a neck seal 6. Possibly, a ring 4 can be assembled around the valve body 10, in particular to decrease the dead volume in the inverted position and so as to limit contact between the fluid product and the neck seal 6. This ring 4 can be of any shape, and the example of FIG. 1 is not limiting. In general, the reservoir contains the fluid product and the propellant, in particular a formulation made up of one or more active principle(s) in suspension and/or in solution in a liquefied propellant, as well as possible excipients. The propellant preferably comprises HFA-152a. In a variant, other non-harmful gases can be used, such as HFO1234ze.

The valve body 10 comprises a cylindrical portion 15 in which the spring 8 is arranged, and in which the collar 320 slides between its rest and dispensing positions. In the position of FIG. 1, this cylindrical portion 15 is the lower portion of the valve body. This cylindrical portion 15 comprises one or more longitudinal openings 11, such as slots, extending laterally in said cylindrical portion 15 of the valve body, over a portion of the axial height of the valve body in the direction of the longitudinal central axis. These openings 11 make it possible to fill the metering chamber 20 after each actuation, when in the inverted position of use (with the valve arranged below the reservoir), when the valve 30 returns from its dispensing position to its rest position.

The valve 30 is urged towards its rest position by a spring 8 that is arranged in the valve body 10 and that cooperates on the one hand with this valve body 10, and on the other hand with the valve 30, preferably with a radial collar 320 of the valve 30. A metering chamber 20 is defined inside the valve body 10, said valve 30 sliding inside said metering chamber 20 so as to enable its contents to be dispensed when the valve is actuated.

In a known manner, the valve 30 can be made of two portions, namely an upper portion 31 (also called valve top) and a lower portion 32 (also called valve bottom).

The upper portion 31 comprises a central axial channel 35 provided with an axial outlet orifice 301 and a radial inlet channel 302 which is arranged in the metering chamber 20 when the valve 30 is in its dispensing position. The upper portion 31 also comprises a radial shoulder which, in the rest position represented in FIG. 1, bears under the valve seal 21, in a known manner.

In this embodiment, the lower portion 32 is assembled inside the upper portion 31.

An internal channel 33 is provided in the valve 30, in particular in the lower portion 32, that makes it possible to connect the metering chamber 20 to the reservoir, so as to fill said metering chamber 20 after each actuation of the valve, when the valve 30 returns to its rest position under the effect of the spring 8. Filling is performed when the device is still in its inverted position of use, with the valve arranged below the reservoir.

In the example of FIG. 1, when the valve 30 is in the rest position, the metering chamber 20, outside of the valve 30, is substantially isolated from the reservoir 1 by the cooperation between the bottom portion 32 of the valve 30 and the chamber seal 22. In this rest position, the metering chamber 20 thus remains connected to the reservoir 1 merely via said internal channel 33. The valve represented in FIGS. 1 and 2 is thus a retention valve. However, the invention is also applicable to other types of valves, in particular valves of the non-priming types.

Advantageously, the pump body 10 comprises, at its lower axial edge, an axial profile 16 projecting upwards, to define the actuation position of the valve by cooperating with the lower edge of the valve 30. This implementation guarantees a precise and identical definition to each actuation of this actuation position, independent from the compression of the spring 8. Also, it makes it possible to ease the spring 8, which makes it possible to increase its service life.

This axial profile 16 can advantageously be made in the shape of a sleeve radially offset inwards from said cylindrical portion 15, as represented in FIG. 1. This particular implementation makes it possible to form a receiving space for the spring 8 between said sleeve 16 and said cylindrical portion 15, making it possible to guide the spring 8 and to hold it in a repeatable position, thus limiting the tilting risks of the valve 30. It must be noted that this projecting profile 16 represented in FIG. 1 is not essential for the operation of the valve, and it could be implemented independently from the structure of the metering chamber.

The volume of the metering chamber 20 is defined by means of a chamber insert 40, of substantially cylindrical shape, with a cylindrical wall 49 having a more or less large radial thickness according to the desired volume. Thus, it is mainly this cylindrical wall 49 which defines the volume of the metering chamber 20. This volume can advantageously vary between 25 and 75 μl. Thus, in the example of FIGS. 3 and 5, which show a metering chamber 20, the volume of which is 50 μl, the radial width of the cylindrical wall 49 is smaller than in the example of FIGS. 4 and 6, which show a metering chamber 20, the volume of which is 28 μl.

The valve seal 21 rests on the upper edge 41 of the chamber insert 40, and the chamber seal 22 is in contact with the lower edge 43 of the chamber insert 40. The upper edge 41 advantageously comprises a projecting profile 42 which penetrates in the valve seal 21, and the lower edge 43 advantageously comprises a projecting profile 44 which penetrates in the chamber seal 22. Advantageously, the lower edge 43 extends radially inwards by a flange 46 which increases the contact surface with the chamber seal 22.

According to the invention, the upper edge 41 of the chamber insert 40 comprises an annular cutout 45, preferably rectangular in cross-section, formed on the radially inner side of said upper edge 41. Thus, the upper edge 41 in contact with the valve seal 21 always has the same width, whatever the width of the cylindrical wall 49. The positioning of the valve seal 21 on the chamber insert 40 is thus always identical, whatever the width of the cylindrical wall 49 and thus the volume of the metering chamber 20. It is the cutout 45 which will have a more or less large width according to the width of the cylindrical wall 49. Due to this, the behaviour of the valve seal 21 will always be the same, whatever the volume of the metering chamber 20.

As can be seen in the figures, the axial dimension of this annular cutout 45 is small. The annular cutout 45 is thus formed only at said upper edge 41, without extending axially significantly in the metering chamber. Thus, this annular cutout 45 almost has no impact on the volume of the metering chamber 20 defined by the radial dimension of the cylindrical wall 49. In particular, the axial dimension of the annular cutout 45 is less than 15%, advantageously less than 10%, of the axial dimension of the cylindrical wall 49. Likewise, the axial dimension of the annular cutout 45 is less than the axial dimension of the radial shoulder of the top portion 31 of the valve 30, as can be seen in FIGS. 1, 3 and 4.

The presence of the cutout 45 moreover makes it possible to absorb and to compensate for the deformation of the valve seal 21, in particular its upper swelling in contact with the gas HFA-152a or HFO1234ze with respect to the conventional gases HFA-134a and/or HFA-227.

Advantageously, in the variant with the flange 46, the lower edge 43 and said flange 46 together form a contact surface with the chamber seal 22 which is always identical, whatever the width of the cylindrical wall 49. The positioning of the chamber seal 22 on the chamber insert 40 is thus always identical, whatever the width of the cylindrical wall 49 and thus the volume of the metering chamber 20. Due to this, the behaviour of the chamber seal 22 will always be the same, whatever the volume of the metering chamber 20.

Although the present invention has been described in reference to two particular embodiments thereof, it is understood that it is not limited by the examples shown. On the contrary, any useful modification could be applied thereto by a person skilled in the art, without going beyond the scope of the present invention, as defined by the accompanying claims.

The invention claimed is:

1. A metering valve for dispensing a fluid product, comprising a valve body containing a metering chamber, said metering chamber being defined by a chamber insert and two annular seals, a valve seal and a chamber seal, said chamber insert comprising a cylindrical wall, an upper edge cooperating with said valve seal and a lower edge cooperating with said chamber seal, a valve sliding axially in said valve body between a rest position and a dispensing position, to selectively dispense contents of said metering chamber, said valve being urged towards the rest position by a spring cooperating on the one hand with said valve body and on the other hand with said valve, wherein said upper edge of said chamber insert comprises an annular cutout formed on a radially inner side of said upper edge, in such a way that a width of said upper edge in contact with said valve seal is always the same, whatever a radial width of said cylindrical wall;

wherein an axial dimension of said annular cutout is less than an axial dimension of a radial shoulder of said valve which, in the rest position of said valve, bears under said valve seal; and wherein said metering chamber has a variable volume defined by the radial width of said cylindrical wall.

2. The metering valve according to claim 1, wherein said annular cutout is of rectangular shape in transverse cross-section.

3. The metering valve according to claim 1, wherein said lower edge of said chamber insert extends radially inwards by a flange which increases a contact surface with said chamber seal, said contact surface always being the same, whatever the width of said cylindrical wall.

4. The metering valve according to claim 1, wherein the metering chamber has a volume of 50 μl.

5. The metering valve according to claim 1, wherein the metering chamber has a volume of 28 μl.

6. The metering valve according to claim 1, wherein the axial dimension of said annular cutout is less than 15% of an axial dimension of said cylindrical wall.

7. A dispensing device, comprising a metering valve according to claim 1, said valve being mounted on a reservoir containing the fluid product and a propellant.

8. The device according to claim 7, wherein said propellant comprises HFA-152a and/or HFO1234ze.

9. The metering valve according to claim 1, wherein said metering chamber has a variable volume between 25 and 75 μl, defined by the radial width of said cylindrical wall.

10. The metering valve according to claim 1, wherein the axial dimension of said annular cutout is less than 10% of an axial dimension of said cylindrical wall.

11. A metering valve for dispensing a fluid product, comprising a valve body containing a metering chamber, said metering chamber defined by a chamber insert selected from a plurality of chamber inserts, each having a different cylindrical wall with a different radial width, and two annular seals, a valve seal and a chamber seal, said chamber insert comprising the respective cylindrical wall, an upper edge cooperating with said valve seal and a lower edge cooperating with said chamber seal, a valve sliding axially in said valve body between a rest position and a dispensing position, to selectively dispense contents of said metering chamber, said valve urged towards the rest position by a spring cooperating on the one hand with said valve body and on the other hand with said valve, wherein said upper edge of said chamber insert comprises an annular cutout formed on a radially inner side of said upper edge, in such a way that a width of said upper edge in contact with said valve seal is always the same regardless of the selected chamber insert;

wherein an axial dimension of said annular cutout is less than an axial dimension of a radial shoulder of said valve which, in the rest position of said valve, bears under said valve seal; and wherein said metering chamber volume is defined by the radial width of the respective cylindrical wall.

12. A metering valve system comprising the metering valve according to claim 11 and the plurality of chamber inserts that define a range of volumes for the metering chamber between 25 and 75μ1.

* * * * *